US008491349B2

(12) United States Patent
Steinhour

(10) Patent No.: US 8,491,349 B2
(45) Date of Patent: Jul. 23, 2013

(54) ADJUSTABLE PADDLE FOR WATERCRAFTS

(76) Inventor: Dirk Steinhour, Lyle, WA (US)

( * ) Notice: Subject to any disclaimer, the term of this patent is extended or adjusted under 35 U.S.C. 154(b) by 150 days.

(21) Appl. No.: 13/136,104

(22) Filed: Jul. 22, 2011

(65) Prior Publication Data

US 2012/0028518 A1 Feb. 2, 2012

Related U.S. Application Data

(60) Provisional application No. 61/400,538, filed on Jul. 29, 2010.

(51) Int. Cl.
*B63H 16/04* (2006.01)

(52) U.S. Cl.
USPC ..... 440/101

(58) Field of Classification Search
USPC ..... 440/101
See application file for complete search history.

(56) References Cited

U.S. PATENT DOCUMENTS

| | | | | |
|---|---|---|---|---|
| 4,017,913 | A * | 4/1977 | Judd | 4/378 |
| 5,371,923 | A * | 12/1994 | Chang | 16/113.1 |
| 5,669,103 | A * | 9/1997 | Hui | 16/113.1 |
| 6,179,514 | B1 * | 1/2001 | Cheng | 403/377 |
| 6,544,087 | B1 * | 4/2003 | Peng | 440/101 |

* cited by examiner

*Primary Examiner* — Stephen Avila

(57) ABSTRACT

This disclosure is directed to a paddle for a watercraft having an adjustable shaft with upper and lower telescoping shaft portions. A lever in the palm grip applies tension to a cable to compress a plug at the end of the upper shaft portion to frictionally engage the lower shaft portion.

8 Claims, 3 Drawing Sheets

ADJUSTABLE PADDLE FOR WATERCRAFTS

CROSS REFERENCE TO RELATED APPLICATIONS

This application is a continuation-in-part of U.S. Provisional Patent Application Ser. No. 61/400,538, filed on Jul. 29, 2010, which is hereby incorporated by reference in its entirety.

FIELD OF THE PRESENT INVENTION

The present disclosure generally relates to paddles for use with watercraft and more specifically to paddles having an adjustable length shaft.

BACKGROUND OF THE INVENTION

Stand up Paddleboarding (SUP) is a new sport that requires the use of a very long paddle with a canoe style blade on one end and a palm grip or T Top on the other end. While traditional canoe paddles are designed for the paddler to use while sitting, SUP paddles, as the name implies, are designed for paddling while standing upright on a surfboard like craft.

A SUP paddler might engage in two relatively different sports while paddling: Surfing on waves or touring. The two sports are very different in how the paddlers use the paddle, and in SUP, the craft is designed to surf as well as travel over long distances of water, called touring. Because SUP users may engage in both activities in the same outing, the need to shorten the paddle for surfing and then lengthen it for touring exists.

In addition to the applications associated with SUP, any canoe-type paddle having an adjustable length shaft is desirable for other reasons. For example, the ability to adjust the length of the paddle allows a single paddle to accommodate users of different sizes or ages or allows the user to adjust the length for different conditions. Adjustable shaft length paddles also provide the advantage of facilitating travel by having the ability to provide a more compact form. Yet another benefit of an adjustable length paddle is the capability of adapting to different applications or uses. Accordingly, these and other reasons make adjustable length a beneficial feature of paddles used with watercraft.

Due to the many advantages, a number of adjustable length paddles exist, including those adapted for SUP. However, these prior art designs typically suffer from the inherent flaw that the mechanism to adjust the length protrudes or is located on the exterior of the shaft, entering into the space used by the hands. This creates a spot where the hand can no longer freely slide up and down the shaft while paddling, surfing, touring or otherwise employing the paddle with the watercraft. Furthermore, such designs also typically require holes in the shaft that weaken the structure. Other types of adjustable paddles have an internal mechanism, but the adjustment of these paddles is neither obvious to the user or requires complicated maneuvers to effect the change in length.

Therefore, there is a need for a watercraft paddle having an adjustable length shaft. Similarly, there is a need for such a paddle that provides adjustability while offering a smooth and unencumbered shaft to facilitate use. It would be desirable for the adjustment to be obvious to the user, and simple to operate allowing for quick adjustment while paddling. Further, there is a need for such a paddle that maintains the structural integrity of the shaft without additional holes. This invention satisfies these and other needs.

SUMMARY OF THE INVENTION

In accordance with the above needs and those that will be mentioned and will become apparent below, this disclosure is directed to a paddle for a watercraft having an adjustable shaft comprising a lower tubular shaft portion having an interior diameter, an upper shaft portion telescopically disposed within the interior diameter of the lower shaft portion, a palm grip carrying an actuator lever at a proximal end of the upper shaft portion, a cable secured to the lever and configured to transmit force to a deformable plug positioned at a distal end of the upper shaft portion, wherein tension applied to the cable by the lever compresses the plug to frictionally engage the lower shaft portion.

In one aspect, the upper shaft portion has a longitudinal axis and the palm grip has a transverse portion oriented substantially perpendicular to the longitudinal axis of the upper shaft portion surface, configured to engage a user's palm. Preferably, the lever pivots around an axle aligned with the transverse portion of the palm grip. Also preferably, the palm grip further comprises a recess configured to receive the lever when in a closed position.

In another aspect, the distal end of the upper shaft portion has a stop against which the deformable plug is configured to compress when tension is applied to the cable. Preferably, the plug and the stop have complementary surfaces configured to mate with each other and to prevent rotation of the plug and the stop with respect to each other when the plug is compressed against the stop. In one embodiment, the complementary surfaces comprise a pattern of projections and indentations.

In yet another aspect, the lever has a closed position that applies tension to the cable and an open position that releases tension on the cable. Preferably, the cable is attached to the lever in an over center position so that tension in the cable creates a closing force on the lever as the lever is moved adjacent the closed position.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

At the outset, it is to be understood that this disclosure is not limited to particularly exemplified materials, architectures, routines, methods or structures as such may, of course, vary. Thus, although a number of such options, similar or equivalent to those described herein, can be used in the practice of embodiments of this disclosure, the preferred materials and methods are described herein.

Unless defined otherwise, all technical and scientific terms used herein have the same meaning as commonly understood by one having ordinary skill in the art to which the disclosure pertains. Finally, as used in this specification and the appended claims, the singular forms "a, "an" and "the" include plural referents unless the content clearly dictates otherwise.

The invention describes a SUP or canoe paddle with an adjustable length mechanism that leaves exterior of the shaft without any protrusions, collets, holes, or buttons. The control for the mechanism is built into the paddle palm grip. The palm grip is the ending of the shaft that is designed to interact with the palm and allow for the added control of gripping the top end of the shaft so that the hand is positioned horizontal, or 90 degrees, to the axis of the shaft. The top is not round, and is preferably aligned with the blade. This gives the user a smooth, uninterrupted shaft surface and the ability to adjust length easily.

Furthermore, as described in detail below, the invention includes a direct mechanical tension element that is very lightweight and has minimal moving parts to corrode in the salty marine environment, and works well when wet or with sand on the moving parts.

Figure 1:
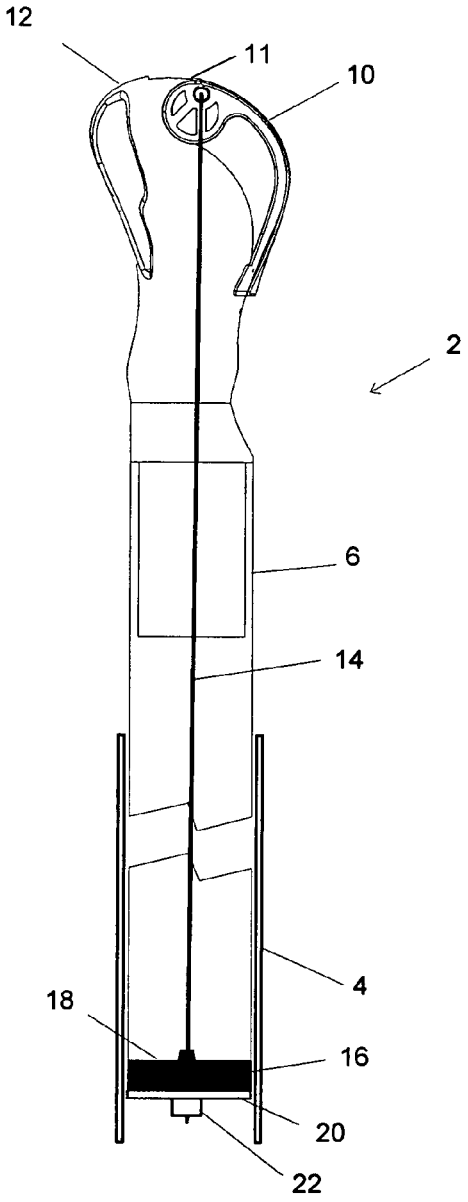
FIG. 1 shows an elevational view, partially in section, of an adjustable shaft paddle with a closed lever, according to the invention.
Figure 2:
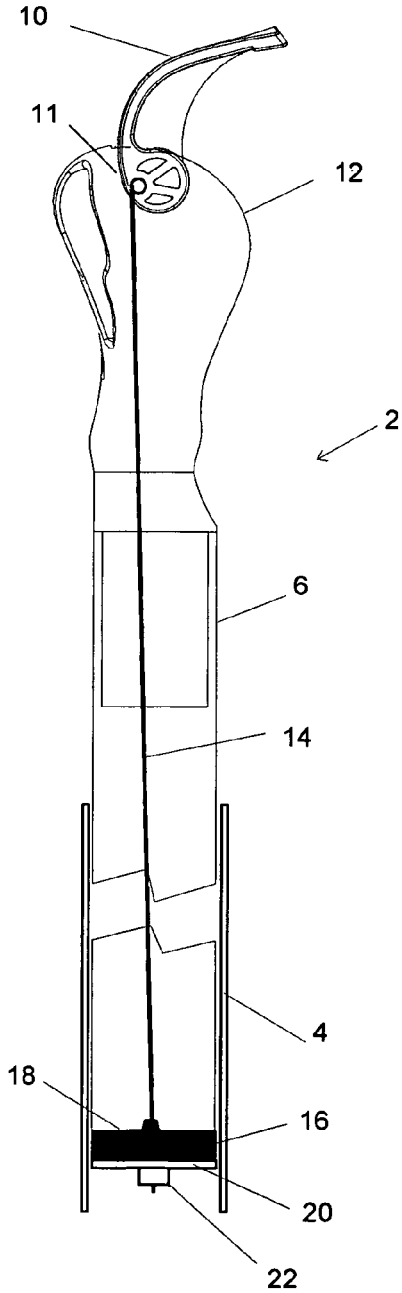
FIG. 2 shows an elevational view, partially in section, of an adjustable shaft paddle with an open lever, according to the invention.

As shown in FIGS. 1 and 2, adjustable paddle 2 includes a lower tubular shaft element 4, which terminates in a conventional blade (not shown). Any suitable blade design can be used. Upper tubular shaft element 6 fits telescopically within lower portion 4, preferably with adequately tight tolerance to avoid undue deflection between the two portions when they are in a telescoping relationship. Actuator lever 10 pivots on axle 11, which is preferably oriented parallel with palm grip 12. A first end of cable 14 is attached to axle 11 and the second end is attached to deformable plug 16 at the end of the extendable shaft element 6. Tension on cable 14 pulls plug 16 against stop 18, which is fixed to upper shaft 6 in any suitable manner.

When lever 10 is closed, as shown in FIG. 1, it lays flush with exterior of palm grip 12. Cable 14 is attached to an outer radius of axle 11, such that the closed position of lever 10 places cable 14 under tension. Cable 14 runs through plug 16, washer 20 and terminates at cable end 22. Cable end 22 stops cable 14 at washer 20, which in turn distributes force applied to cable 14 to plug 16. Preferably, cable end 22 is threaded to provide a mechanism for fine tuning the tension imparted to cable 14 when lever 10 is in the closed position. Accordingly, tension on cable 14 moves washer proximally toward palm grip 12. Since stop 18 at the end of shaft 6 prevents motion of plug 16, the plug is compressed axially which generates a radial expansion force. The expansion force of compressed plug 16 creates the necessary friction against lower shaft 4 to fix upper shaft 6 at a desired position.

Figure 3:
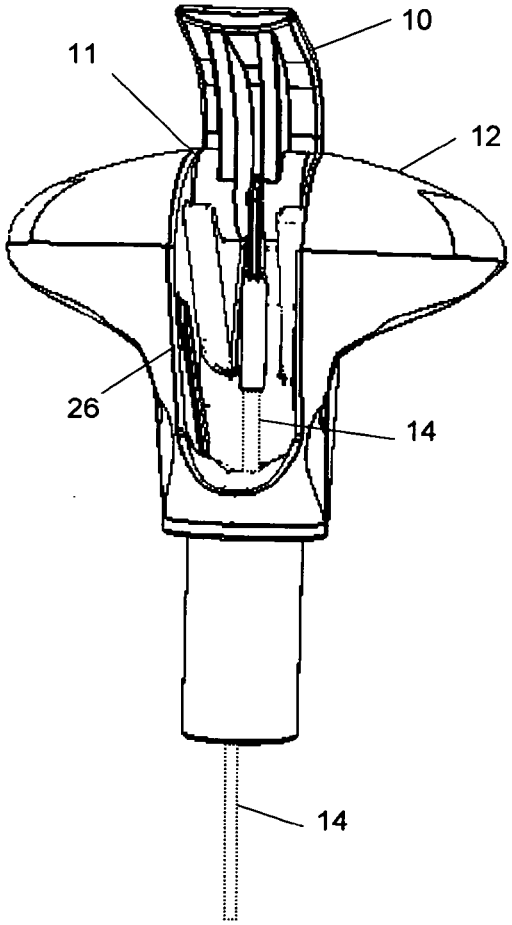
FIG. 3 shows a detail view of the palm grip of an adjustable shaft paddle, according to the invention.

Correspondingly, opening lever 10 as shown in FIG. 2, releases tension from cable 14. Plug 16 then is allowed to return to its nominal dimensions, greatly reducing or eliminating the friction due to plug 16 with lower shaft 4. Thus, upper shaft element 6 can telescope freely within lower shaft element 4 to provide easy adjustment of the overall length. FIG. 3 is a detail view of palm grip 12.

Figure 4:
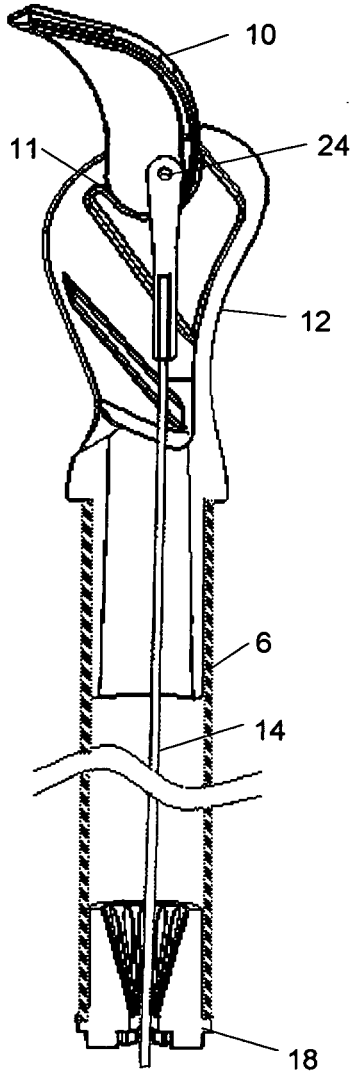
FIG. 4 shows a side, cross-sectional view of the palm grip and upper shaft portion of an adjustable shaft paddle, according to the invention.

FIG. 4 shows an alternate, cross-sectional side view of palm grip 12 and upper shaft 6. As can be seen, cable 14 is secured to lever 10 via pivot 24. Axle 11 of lever 10 rests in a cradle 26 formed by the body of grip 12. Thus, when lever 10 is moved to a closed position, pivot 24 is rotated to apply tension to cable 14. Preferably, pivot 24 is positioned in an over center location, so that tension on the cable will tend to pull the lever into a closed position once pivot 24 travels beyond the apex of axle 11. FIG. 3 also shows recess 26 formed in palm grip 12, which is configured to receive lever 10 when in a closed position to provide a smooth surface for the user's palm.

Figure 5:
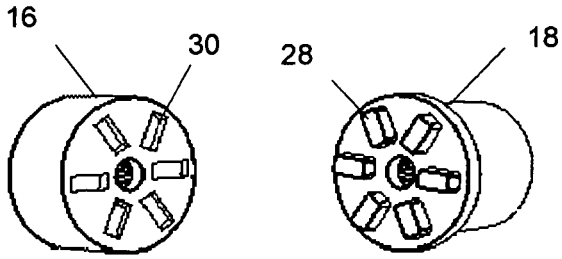
FIG. 5 shows a detail view of the plug and stop of an adjustable shaft paddle, according to the invention.

FIG. 5 shows detail views of plug 16 and stop 18. Preferably, the mating faces of plug 16 and stop 18 have complementary features configured to prevent rotation with respect to each other. As shown, stop 18 features a plurality of projections 28. Corresponding indentations 30 on plug 16 are configured to receive the projections. Thus, particularly when under tension, plug 16 mates with stop 18 to prevent undesirable rotation of upper shaft 6 with respect to plug 16. As will be appreciated, this configuration helps prevent rotation of upper shaft 6 with respect to lower shaft 4, ensuring that the user has positive control over the orientation of the paddle blade with palm grip 12.

As will be recognized by one of skill in the art, several materials are suitable for construction of the various elements of the paddle. For example, in a preferred embodiment, palm grip 12 and lever 10 are formed from injection molded plastic, upper shaft 6 and lower shaft 4 are formed from a carbon composite material, deformable plug 16 is formed from rubber, polyurethane, or other similarly compliant material, and cable 14, washer 20 and cable end 22 is formed from stainless steel or other corrosion resistant material. These materials are representative only, and can be substituted as desired.

Described herein are presently preferred embodiments. However, one skilled in the art that pertains to the present invention will understand that the principles of this disclosure can be extended easily with appropriate modifications to other applications.

What is claimed is:

1. A paddle for a watercraft having an adjustable shaft comprising a lower tubular shaft portion having an interior diameter, an upper shaft portion telescopically disposed within the interior diameter of the lower shaft portion, a palm grip carrying an actuator lever at a proximal end of the upper shaft portion, a cable secured to the lever and configured to transmit force to a deformable plug positioned at a distal end of the upper shaft portion, and a stop at the distal end of the upper shaft portion, wherein tension applied to the cable by the lever compresses the plug against the stop, causing the plug to frictionally engage the lower shaft portion.

2. The paddle of claim 1, wherein the upper shaft portion has a longitudinal axis and wherein the palm grip has a transverse portion oriented substantially perpendicular to the longitudinal axis of the upper shaft portion surface and configured to engage a user's palm.

3. The paddle of claim 2, wherein the lever pivots around an axle aligned with the transverse portion of the palm grip.

4. The paddle of claim 3, wherein the palm grip further comprises a recess configured to receive the lever when in a closed position.

5. The paddle of claim 1, wherein the plug and the stop have complementary surfaces configured to mate with each other and to prevent rotation of the plug and the stop with respect to each other when the plug is compressed against the stop.

6. The paddle of claim 5, wherein the complementary surfaces comprise a pattern of projections and indentations.

7. The paddle of claim 1, wherein the lever has a closed position that applies tension to the cable and an open position that releases tension on the cable.

8. The paddle of claim 7, wherein the cable is attached to the lever in an over center position so that tension in the cable creates a closing force on the lever.

* * * * *